United States Patent [19]

Hanscom

[11] Patent Number: 4,466,227

[45] Date of Patent: Aug. 21, 1984

[54] MACHINE FOR WRAPPING TAPE ABOUT AN ARTICLE

[75] Inventor: John F. Hanscom, Rehoboth, Mass.

[73] Assignee: H. F. Hanscom & Company, Inc., Providence, R.I.

[21] Appl. No.: 334,459

[22] Filed: Dec. 24, 1981

[51] Int. Cl.[3] ..... B65B 63/02

[52] U.S. Cl. ..... 53/528; 53/586; 53/590; 53/218; 53/229; 53/389; 53/371

[58] Field of Search ..... 53/218, 228, 229, 329, 53/389, 399, 528, 582, 586, 590, 371; 100/3, 33 PB

[56] References Cited

U.S. PATENT DOCUMENTS

| | | | |
|---|---|---|---|
| 1,649,327 | 11/1927 | Sheldon | 53/590 |
| 1,864,775 | 6/1932 | Straubel | 53/590 X |
| 2,050,713 | 8/1936 | Malocsay | 53/218 X |
| 2,237,911 | 4/1941 | Neumair | 53/466 X |
| 2,285,715 | 6/1949 | Hopkins | 53/55 |
| 2,543,323 | 2/1951 | Marsh | 156/355 |
| 3,416,287 | 12/1968 | Hawkins et al. | 53/399 |
| 3,716,963 | 2/1973 | Amberg | 53/329 X |
| 3,967,767 | 7/1976 | Seragnoli | 53/389 X |
| 4,276,736 | 7/1981 | Haberstroh et al. | 53/590 X |

*Primary Examiner*—Robert L. Spruill
*Assistant Examiner*—Steven P. Weihrouch
*Attorney, Agent, or Firm*—Barlow & Barlow, Ltd.

[57] ABSTRACT

A machine for wrapping tape about an article in which a suppy of tape with adhesive on one side thereof is fed across a pair of spaced stationary jaws along a feeding platform and cut to a size for the bundle to be wrapped. The bundle to be wrapped is placed in the jaws, and against the tape, while holding bars, that reciprocate in the jaws, engage the ends of the tape, and move the tape upwardly about the bundle. Pincher jaws are provided and are located across the upstanding ends of the tape. The jaws squeeze the two ends together to secure the bundle and ejecting means move the bundle out of the jaws.

5 Claims, 9 Drawing Figures

MACHINE FOR WRAPPING TAPE ABOUT AN ARTICLE

BACKGROUND OF THE INVENTION

There have been proposed a number of apparatuses for banding material in the form of tape about bundles, or about single objects. For example, in the Neumair patent, U.S. Pat. No. 2,237,911 (Class 53-466), a band has been proposed for cigars in which a cigar is pushed up into jaws that will clamp the article which will also push the cigar into a band which is subsequently forced by fingers around the cigar. Additionally, it has been proposed in the Weber patent, U.S. Pat. No. 2,234,745 (Class 100-8), to tape bodies by applying a tacky tape to the bodies where rolls are provided to operate in conjunction with a constricting or compacting device which brings the tacky surface of the tape into contact with the bodies being wrapped, the roller operating in such a fashion that the tape is effectively folded over itself. Devices of the aforementioned nature provide a completed bundle structure which is not easily pulled apart. For example, in certain applications it is useful to have the bundle of electric cord, or the like made up in such a way that it is easy to pull the wrapping off by expanding the bundle. The wrapping therefore, should conform to a structure wherein the band is wrapped around the body and then upstanding tab or end portions thereof, adhesively will join to each other so that when separation under force is desired, the banding may readily be disengaged along the adhesive juncture thereof.

SUMMARY OF THE INVENTION

The bander of the present invention provides a supply of tape which may be in roll form, the tape preferably being of a pressure sensitive type that will only adhere to its own adhesive. Metering roll means are provided for feeding a specific length of tape from the supply across a pair of spaced stationary jaws. The bundle which is designed to be taped is then placed between the jaws and into contact with the tape and is pushed downwardly against the stationary stop so as to compact the bundle and folding bars, that reciprocate in the jaws, engage the free ends of the tape and move the tape upwardly around the bundle.

A pivoting arm containing pincher jaws drops into position over the bundle and the jaws come together wherein the adhesive will hold the ends so that the trailing ends of the tape are now secure to each other. An ejector arm then comes up and removes the taped bundle from the jaws after the arm of the pincher jaws have moved out of the way and the cycle is repeated.

DESCRIPTION OF THE PREFERRED EMBODIMENT

Figure 2:
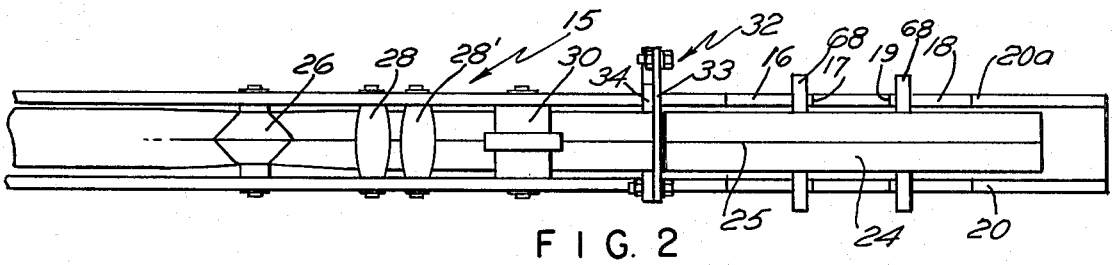
FIG. 2 is a top view of the tape feeding platform with the creaser and feeding rolls.
Figure 3:
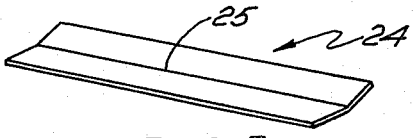
FIG. 3 is a perspective view of the tape which has been suitably creased for feeding across the spaced jaws.

In the drawings there is shown the banding apparatus which essentially is assembled on a mounting plate 10 with suitable vertical supports such as 12, 13, 14. To this support there is affixed a tape feed platform generally designated 15 which is seen better in the top view of FIG. 2, and mounted near one end of the platform are a pair of jaws 16, 18. The jaw 18 is adjustably mounted in side plates **20, 20*a* so as to move there along and be held in position by an adjusting screw 21. At the other end of the platform 15, suitably mounted in a bracket 22, is a roll of tape 24. The tape is fed along the platform 15 where it first undergoes a creasing operation by a creasing roller 26, and thence under a pair of idler rolls 28 and 28' to a driven metering roller 30 which draws the same down the platform. A cutter knife assembly generally designated 32 may consist of a reciprocating knife 33 operating against an anvil 34 by way of a solenoid operating means generally designated as 36 (see FIG. 1). The tape is then fed across the jaws 16 and 18. During the feeding operation the tape will be in the configuration as seen in FIG. 3 with a central crease line 25 which permits the tape to bridge the open space between jaws 16 and 18**.

Rockably mounted in bearings (not shown) is a shaft 40 on which a pair of presser arms such as arm 42 with presser foot 44 are mounted. The presser arms 42 are arranged in such a way that the foot will come down across the open space between the jaws 16 and 18 and are moved in timed sequence into that position by rocking shaft 40. As the arms move downwardly, the spring on rod 48 is loaded and through arm 46 connected to shaft 50, will tend to exert a rotative force on shaft 50.

Figure 1:
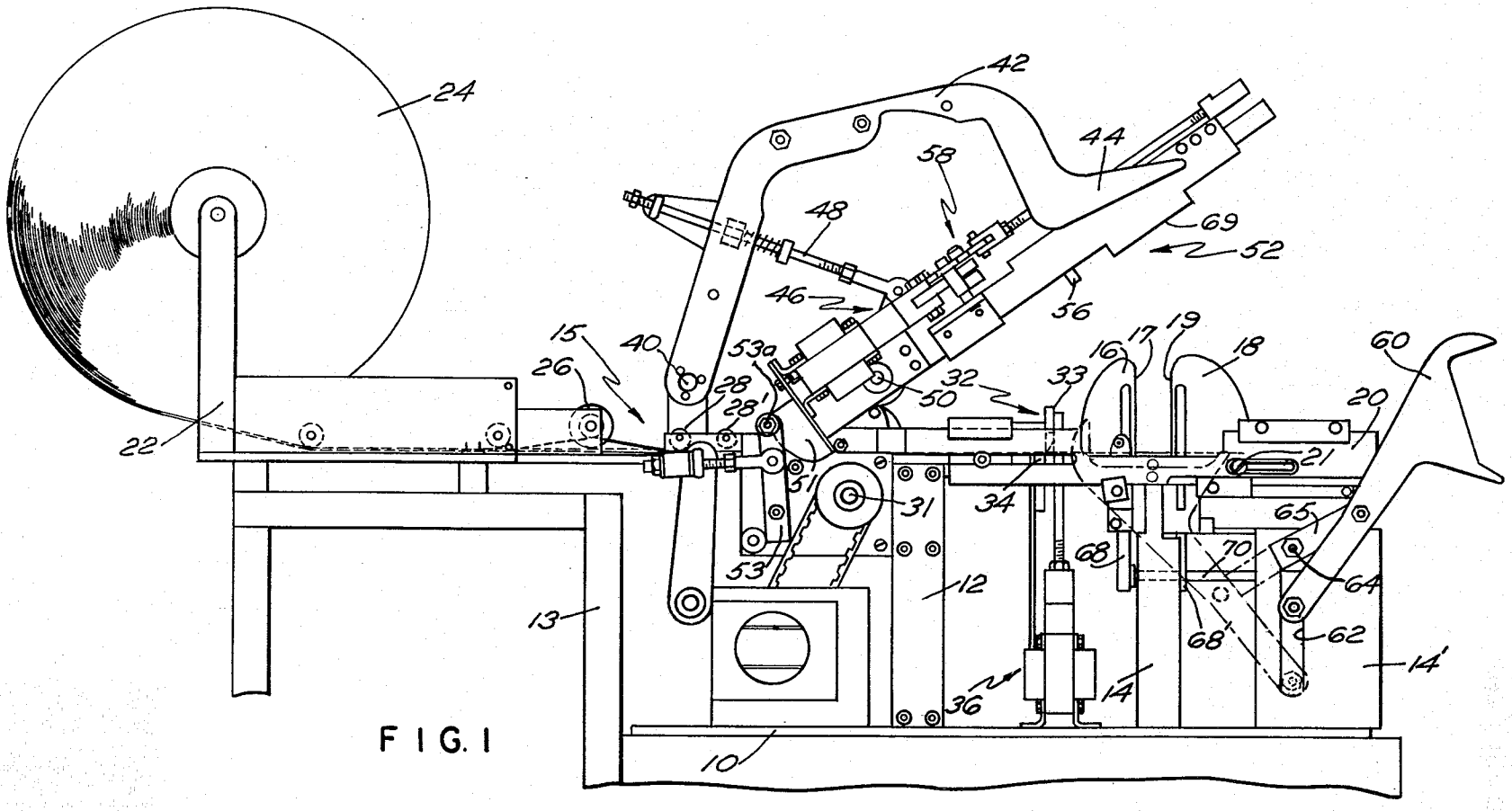
FIG. 1 is an elevational view with parts omitted for clarity, illustrating the banding apparatus constructed in accordance with the present invention.

A block generally designated 52 that contains pincher jaws is fixed to shaft 50 which in turn rotates in bearings (not shown) on the frame. One of the jaws 56 is seen in FIG. 1, and in the diagrammatic views FIGS. 7 and 8, the cooperating jaw 54 is also viewed. Essentially these pincher jaws are rectangular plates that operate with a lazy tong type of operator generally designated 58 which may be suitably actuated in time sequence by any suitable means known to those skilled in the art. The block 52 is retained in an up position by a detent in plate 51 which is engaged by a latch roller **53*a* on arm 53. After presser arms are in position, arm 53 rocks to the left, as seen in FIG. 1, and roller 53*a* engaging the edge surface of plate 51, allows controlled descent. Return to up position is achieved by rotating shaft 50** by means (not shown).

Referring to FIG. 1, an ejector 60 is shown which is mounted in a slot 62 in the vertical plate 14' and which has an operating shaft 64 connected by a link 65 to the arm so that as the shaft 64 rotates left to right as seen in the drawing, the ejector arm will move from the broken line position to the full line position where the material between the jaws 16 and 18 can be ejected.

Mounted for reciprocation within the jaws 16 and 18 are folding bars 68, 68' that are mounted together on a rod 70 (FIG. 8) and reciprocated by any suitable means connected to an operating post 72, yet resiliently held upwardly by a spring 73.

Figure 4:
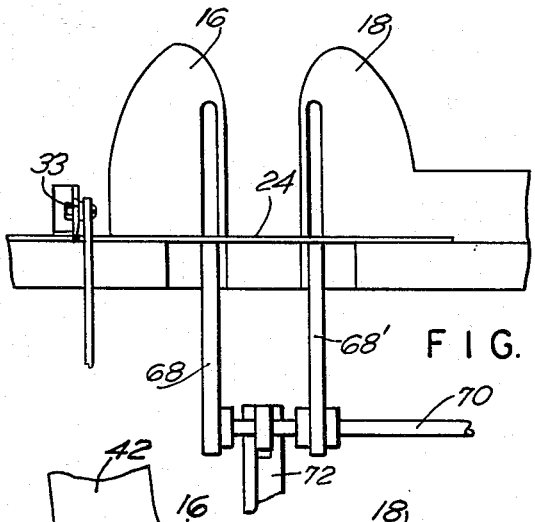
FIGS. 4 through 8 are diagrammatic views showing the sequence of operation of the invention.
Figure 5:
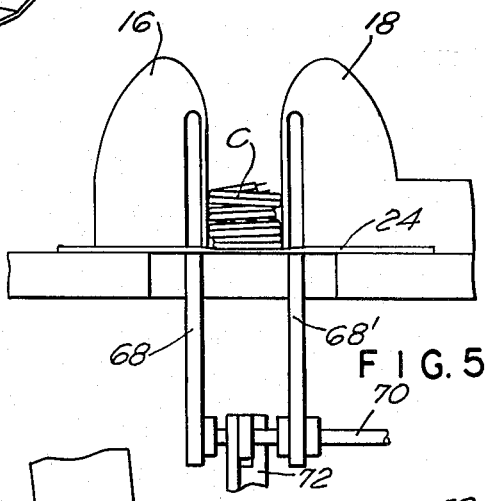
Figure 6:
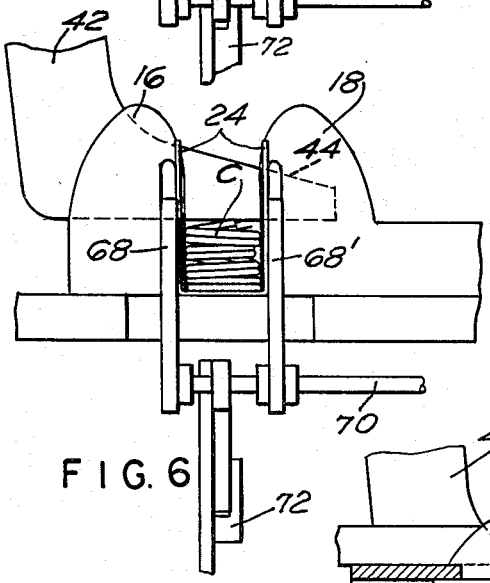
Figure 7:
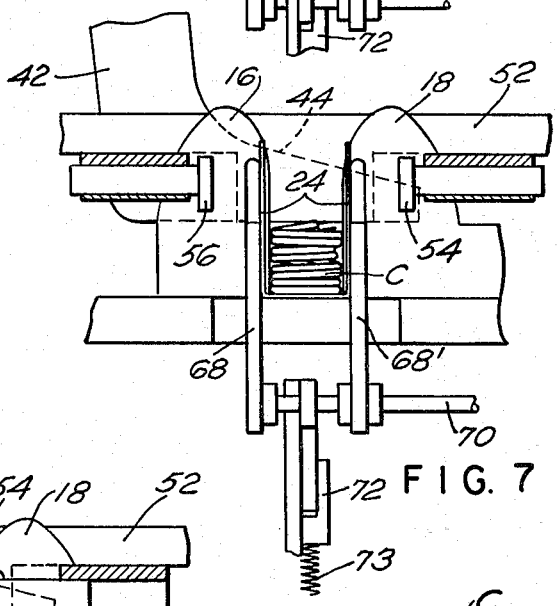
Figure 8:
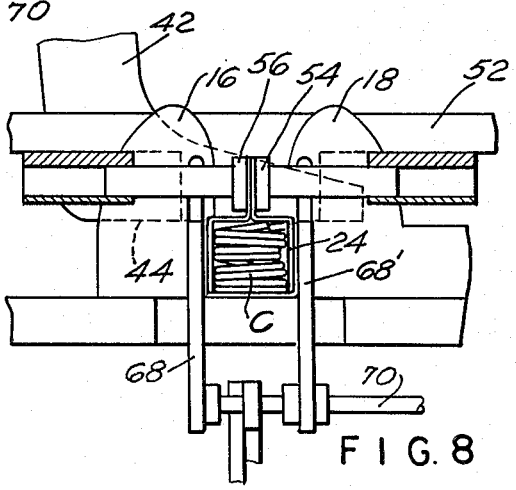
Figure 9:
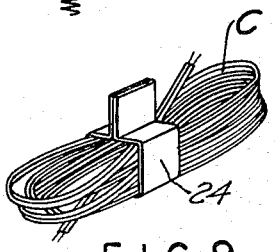
FIG. 9 is a perspective view of a completely wrapped bundle.

To understand how the bander of this invention operates, a sequence of operations will now be described. The tape is advanced by energizing a feed roller (not shown) that is driven off a shaft 31 and will operate to feed a certain length of tape that is necessary to wrap the package being operated upon. The tape is fed across the jaws substantially as seen in FIG. 2 of the drawings. At this point in time the cut-off knife means 36 is momentarily energized when the tape feed motor is deenergized and, as shown in FIG. 4, the solenoid will pull down knife 33 cutting the tape. The article to be banded is then placed between the faces 17, 19 of the jaws 16 and 18, respectively, as seen in FIG. 5 of the drawings. The article shown is a hanked form of electrical cable designated C. The hold-down arms 42 come down into position where the foot 44 presses the package down into the bottom of the jaws and then as seen in FIG. 6 the folder bars 68, 68' are moved upwardly and this brings the free ends of the tape along side the package. Latch roller 53*a* then releases the pincher block 52 which descends, and when it is in position, as seen in FIG. 7 with the folder bars 68, 68' pushed downwardly against spring 73 by face 69 which rests on the article as shown in FIG. 7, means actuate the pincher jaws 54, 56 to pinch the end of the tape as seen in FIG. 8 of the drawings. During the above operations, the ejector arm has been in the position as seen by the broken lines in FIG. 1. At this point in the cycle, the arm 42 rotates counter-clockwise as seen in FIG. 1 being raised to its normal position and rod 48 raises pincher block 52 to latched position. The ejector 60 operates by first raising upwardly to lift the bundle out of the jaws and then throw the same to the right as seen in FIG. 1 by a vertical sliding action that occurs in the slot 62. The finished package is seen in FIG. 9, which is essentially a band with two ends of the band being joined together. At this point in time a new cycle may begin.

I claim:

1. A bander for wrapping tape about an article comprising (a) a supply of tape;

(b) a pair of spaced stationary jaws between which the article to be banded is received, said jaws having opposed faces;

(c) a tape feed platform adjacent one jaw;

(d) means feeding tape from said supply and platform normal to the faces of said jaws so as to lie beneath a location for the article between the jaws;

(e) folding bars reciprocating in said jaws for engaging tape and moving the tape upwardly on opposite sides of the article;

(f) a pincher block pivotally mounted on an axis perpendicular to the feeding direction of the tape, the pincher block including a face, means pivoting said block from an up position to a position wherein the face rests on the article;

(g) pincher jaw means mounted on said block, said pincher jaw means operating substantially normal to the faces of said spaced jaws and engaging the upstanding end portions of the tape to press the end portions together and about the upper portion of the article.

2. A bander as in claim 1 wherein means are provided to compress material in the jaws.

3. A bander as in claim 1 wherein the tape feed platform is provided with a metering wheel and a cut-off knife actuated after a predetermined amount of tape has been fed across said jaws.

4. A bander as in claim 1 wherein a longitudinal folding means is provided to longitudinally crease the tape.

5. A bander as in claim 1 wherein the pincher block moves the folding bars downwardly as it descends to rest on the article between the jaws.

* * * * *